United States Patent [19]

Bubley et al.

[11] 4,058,307

[45] Nov. 15, 1977

[54] FEED AND TAKEOFF ASSEMBLY

[75] Inventors: Henry J. Bubley, Deerfield; John R. Krutsch, Glenview, both of Ill.

[73] Assignee: American Screen Printing Equipment Company, Chicago, Ill.

[21] Appl. No.: 716,761

[22] Filed: Aug. 23, 1976

Related U.S. Application Data

[63] Continuation-in-part of Ser. No. 628,151, Nov. 3, 1975.

[51] Int. Cl.[2] ..... B65H 29/10

[52] U.S. Cl. ..... 271/85; 101/123; 101/408; 198/486; 198/695; 198/696; 214/1 BB; 271/268

[58] Field of Search ..... 271/85, 268, 82, 277, 271/247, 204, 205, 206, 267, 84; 198/479, 486, 650, 654, 653, 695, 696; 214/1 BB, 1 BA; 101/408, 123

[56] References Cited

U.S. PATENT DOCUMENTS

| | | | |
|---|---|---|---|
| 231,444 | 8/1880 | O'Donel | 271/85 |
| 2,413,553 | 12/1946 | Evers | 271/194 X |
| 2,984,178 | 5/1961 | Koch | 271/206 |
| 3,149,714 | 9/1964 | Williams et al. | 198/653 X |
| 3,792,857 | 2/1974 | Bubley et al. | 271/85 |

FOREIGN PATENT DOCUMENTS

| | | | |
|---|---|---|---|
| 912,393 | 12/1962 | United Kingdom | 198/653 |

*Primary Examiner*—Bruce H. Stoner, Jr.
*Attorney, Agent, or Firm*—Robert E. Wagner; Gerald T. Shekleton; Robert E. Browne

[57] ABSTRACT

A feed and takeoff assembly particularly adapted for use in connection with a printing press to automatically transfer generally flat stock from a first position to a print position and to a delivery position, having a frame, a transfer carriage mounted for movement along the frame, a single elongated feed gripper mounted near one end of the transfer carriage and disposed transversely to the path of travel of the carriage along the frame, and a low profile delivery gripper mounted near the opposite end of the transfer carriage for movement therewith along the frame. The single elongated feed gripper is capable of repeated precisely registered movement along the frame through a spring-biased cam-operated guide means. The delivery gripper acts to remove an entire sheet of printed stock at a desired time by a cam-operated opening and closing of pivotally mounted upper and lower jaws. The operation of the transfer carriage and associated feed gripper and delivery gripper relative to the operation of the printing press is timed by a plurality of control cams which provide for feeding and delivery of stock and return of the carriage at optimum speeds without errors in registration.

4 Claims, 12 Drawing Figures

FIG. 4
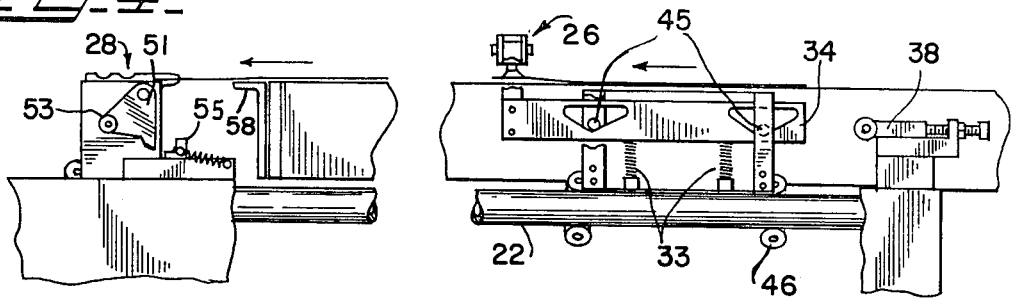
FIG. 6
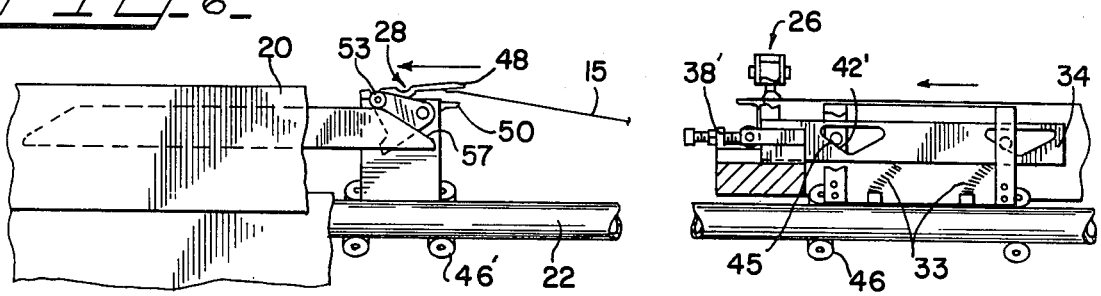
FIG. 8
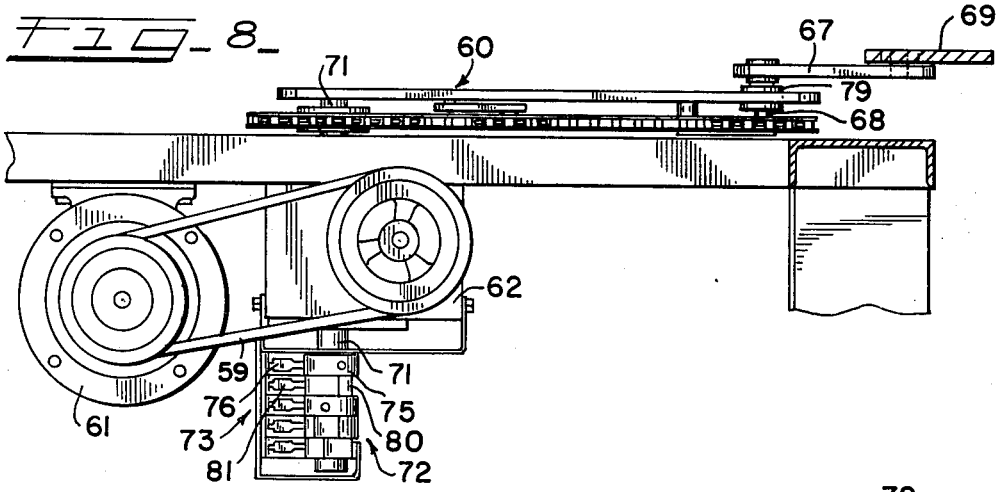
FIG. 7
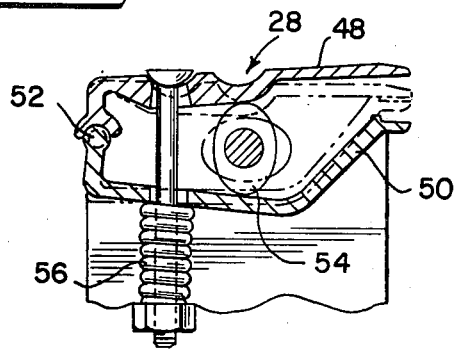
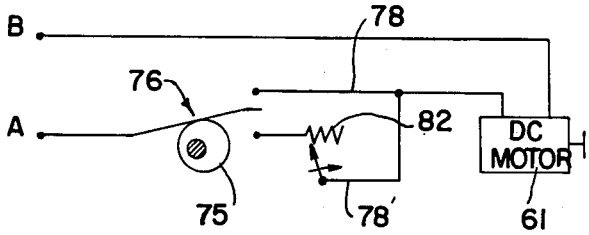
FIG. 9

FEED AND TAKEOFF ASSEMBLY

This application is a continuation-in-part of our copending application Ser. No. 628,151, filed Nov. 3, 1975.

BACKGROUND OF THE INVENTION

This invention relates to a feed and takeoff assembly particularly adapted to transfer sheet stock from a first location, to a second location, to a third location, particularly in combination with the operation of a screen printing press.

The screen printing of the various types and thicknesses of paper and metal stock used in business, advertising and innumerable other applications has increased dramatically in the last few years. The demand for this type of printing often requires high-volume production which, in turn, demands efficiency in the printing process. The automatic and semi-automatic screen printing presses used in this type of work generally include a frame having a printing bed and a pivoting printing head mounted on the frame and holding a screen for placement over the printing bed above the stock to be printed which is placed thereon.

In order to achieve production efficiency and acceptable quality in large volume models of such presses, some kind of automatic or at least semi-automatic device to feed stock to or remove and deliver it from the press is critical. However, there is presently a lack of simple, inexpensive, reliable automatic equipment for feeding, registering and removing stock in connection with a printing press. Therefore, feeding and registering is often done by hand; the press is then activated; and, at best, an automatic takeoff, such as that shown in U.S. Pat. No. 3,860,231 to Claude H. Oltra and manufactured by American Screen Printing Equipment Company of Chicago, Ill., is used to automatically remove the stock.

There are also presently available complex systems of mechanical finger-type grippers which are built directly into the printing press to accomplish feeding, registration and delivery. These devices usually include three or more individual series of independently-operating grippers. One gripper set feeds, one gripper set registers, and two or more gripper sets act to remove the stock from the printing area and deliver it to a final position. Such gripper series are independent of one another and moved by a complex mechanical system of chains and linkages. They must be independently adjusted for various thicknesses and sizes of stock being printed. The expense of such equipment is prohibitive for small firms, and the cost of maintenance, because of possible breakdown and readjustment, is often high.

SUMMARY OF THE INVENTION

The present invention relates to a unitary, automatic feed and takeoff assembly which may be used alone or in conjunction with a screen printing press to provide a reliable, efficient and relatively low-cost means of automatically feeding, registering and delivering stock in a printing operation.

The present invention overcomes the problems of the prior art through the use of a single elongated feed gripper member and a single elongated delivery gripper member, which are mounted in spaced relationship on a transfer carriage assembly movable relative to the printing bed of a printing press on a frame having a pair of parallel spaced rails. The feed gripper member and delivery gripper member are maintained in spaced, parallel relationship near opposite ends of the transfer carriage and move with the transfer carriage as a single unit relative to the printing bed.

In operation, the stock to be printed may be first registered to the outside of the printing bed of the press and the feed gripper member, being mounted on a spring-biased cam-operated mounting plate moved horizontally and vertically relative to the stock to be printed to pick it up by vacuum in a registered position. The transfer carriage then moves along the rails to the frame so that the stock is brought into a printing position by the feed gripper. As the feed gripper is moving toward the printing bed, the delivery gripper, consisting of a pair of elongated, parallel jaws, which pivot open in opposite directions, has simultaneously engaged and gripped a protruding edge of a sheet of printed stock and begun to transfer such stock to a delivery position.

After feeding and delivery has been accomplished, the transfer carriage may be quickly returned to its initial position and begin to repeat the process. The operation of the printing press is preferably timed so that printing is accomplished after return of the transfer carriage.

The unified movement and constant spacing of the feed gripper and the delivery gripper assures reliable, repeated operation of the feed and takeoff assembly, since each piece of stock will always be in proper position after feeding for removal from the printing bed by the delivery gripper. In other words, if a piece of stock can be gripped for feeding, it will be gripped for delivery. The use of a single feed gripper member, which is controlled and limited in its independent vertical and horizontal movement, assures that each piece of stock will always be brought into proper registered position for printing and permit accurate multi-color printing. The use of a basically unitary, elongated delivery gripper member in combination with a dropping edge of the printing bed assures that even the heaviest peice of stock may be gripped along an entire edge for proper removal. In addition, the low profile of the delivery gripper allows positioning of this gripper in close proximity to the stock under the screen when in the print position, thereby increasing over-all speed of operation.

The linear movement of the transfer carriage on which the feed and delivery grippers are mounted is controlled by a DC motor, whose speed is in turn controlled by one or more switching cams which rotate with the movement of the transfer carriage which also provides a harmonic motion to the transfer carriage in its feeding movement.

Accordingly, it is an object of the present invention to provide a feed and takeoff assembly which automatically and simultaneously transfers stock from a first position to a printing position and a delivery position.

It is a further object of the present invention to provide a feed and takeoff assembly in which the feed gripper and delivery gripper are connected so that they move together as a unit to thereby eliminate registration, adjustment and pick-up problems and reduce the number of parts in the apparatus.

It is another object of the present invention to provide a feed and takeoff assembly having a single feed gripper member which is controlled in its independent vertical and horizontal movement so that it both feeds and registers stock accurately.

It is one more object of the present invention to provide a feed and takeoff assembly having a delivery gripper including upper and lower jaws which close over substantially the entire length of an edge of the stock to be removed to assure proper gripping and removal.

It is still another object of the present invention to provide a feed and takeoff assembly operable at variable speeds to permit maximum efficiency without registration errors or gripping problems.

These and other objects of the present invention will become more apparent from the following detailed description of the invention taken in conjunction with the drawings, wherein:

FIG. 4 is a front side elevational, partially cut-away view of the feed and takeoff assembly of the present invention, similar to that shown in FIG. 3, wherein the transfer carriage is feeding stock toward the printing bed of the printing press and removing printed stock from the printing bed of the printing press;

Figure 2:
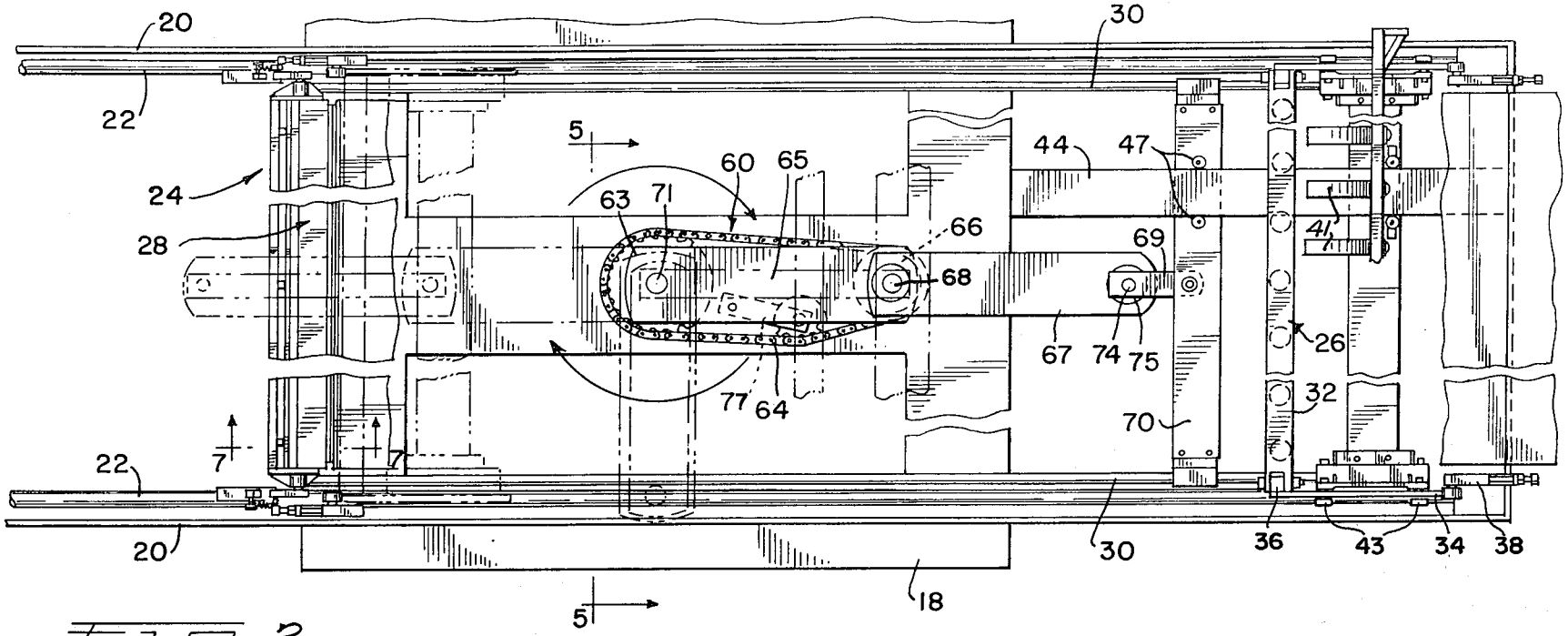
FIG. 2 is a top plan view of the feed and take-off assembly of the present invention with the printing bed of the screen printing press removed to show the features of the present invention.
Figure 10:
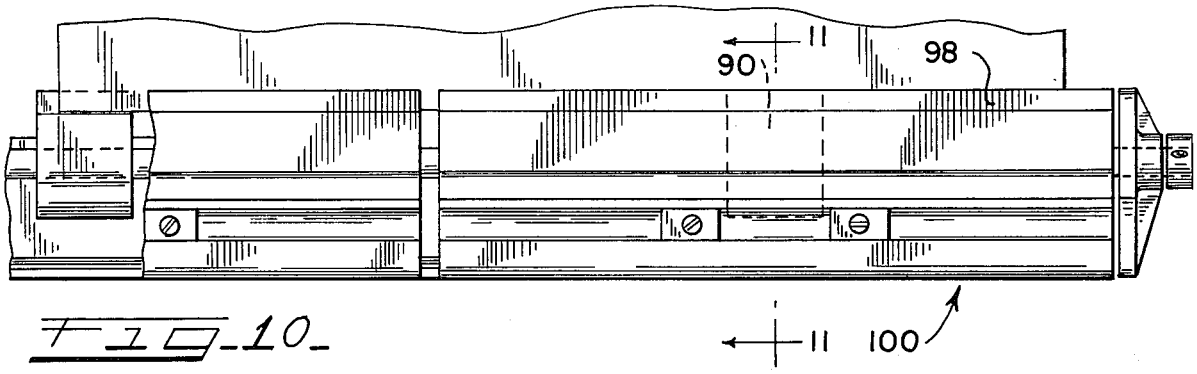
Figure 11:
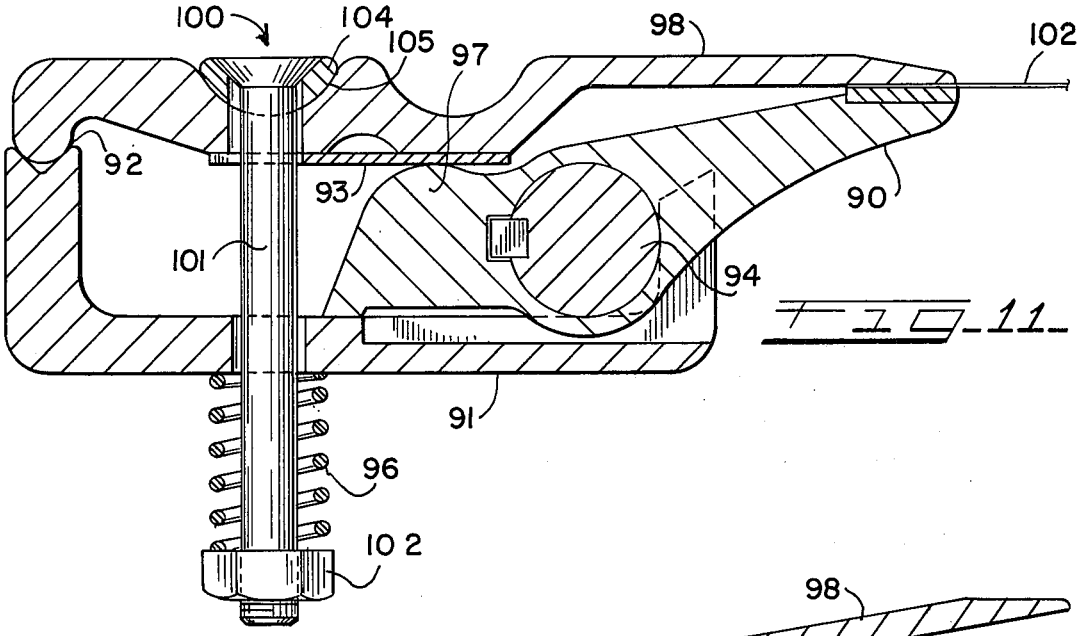
Figure 12:
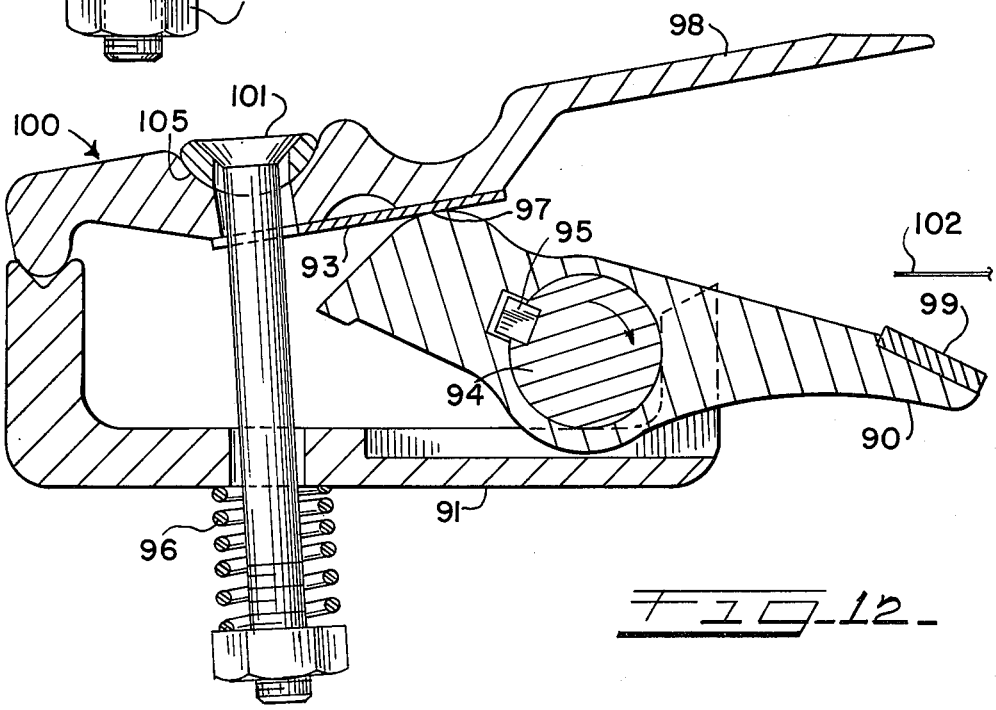

FIG. 6 is a front elevational view, partially cut-away, of the feed and takeoff assembly of the present invention showing the transfer carriage in the extreme left-hand position where the feed gripper member is depositing the stock to be printed on the printing bed of the printing press and the delivery gripper member is depositing the stock which has been printed in a selected third delivery position;

FIG. 7 is a vertical cross-sectional view of the delivery gripper member of the present invention taken generally along line 7—7 of FIG. 2;

FIG. 8 is a front, vertical cross-sectional view of a portion of the feed and takeoff assembly of the present invention showing the feed and takeoff drive motor, the cam controls and the crank drive means connecting the drive motor to the transfer carriage;

FIG. 9 is a simplified circuit diagram showing an electrical control circuit for regulating the speed and movement of the transfer carriage of the present invention;

FIG. 10 shows a top plan view of one embodiment of the takeoff gripper of the present invention, being partially cut away to show a lower jaw;

FIG. 11 is a cross section taken along line 11—11 of FIG. 9 showing the upper and lower jaws of the present invention in the closed position gripping sheet stock; and, FIG. 12 is a cross section taken along lines similar to FIG. 10, showing the upper and lower jaws of the present invention in the open position.

DETAILED DESCRIPTION OF THE DRAWINGS

Figure 1:
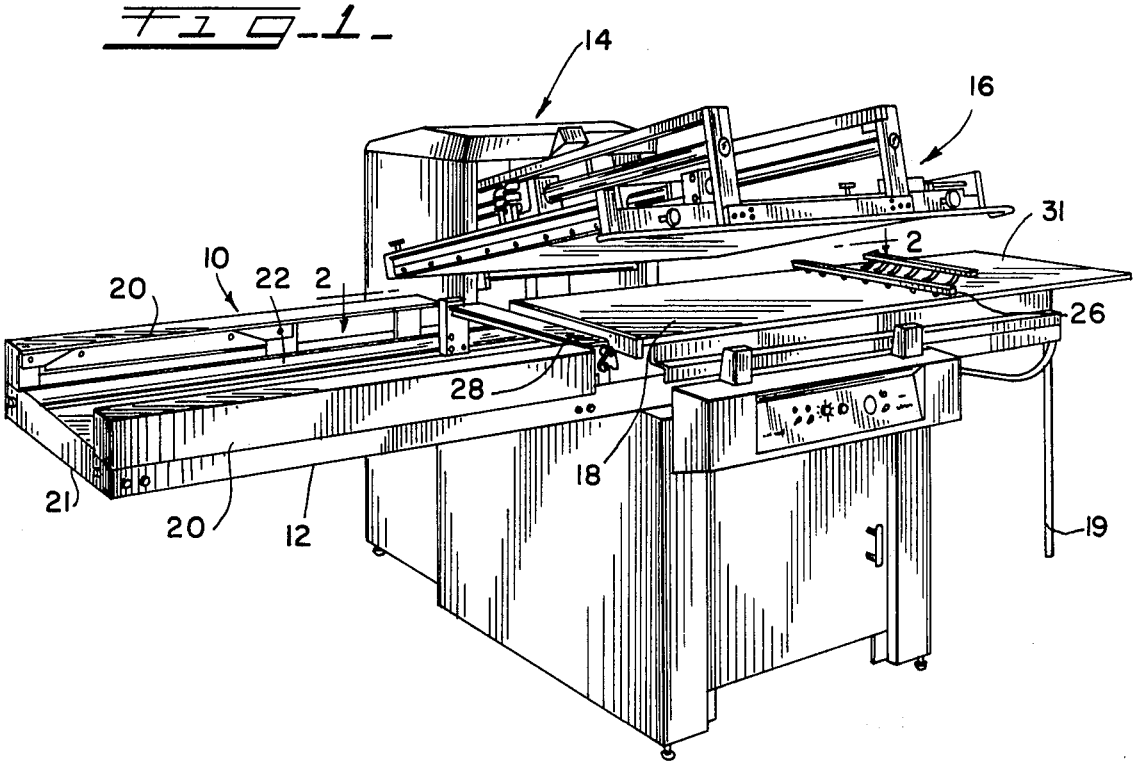
FIG. 1 is a persepctive view of the feed and takeoff assembly of the present invention mounted for use on a screen printing press.

Referring now to the drawings and, in particular, to FIG. 1, the feed and takeoff assembly of the present invention is shown in general at 10 mounted in combination with a screen printing press 14. The feed and takeoff assembly 10 includes an elongated frame 12, which is mounted horizontally across and at right angles to the printing bed 18 of the screen printing press 14. While the screen printing press 14 may be any commerically-available type, having a printing head 16 which drops vertically over a printing bed, or as shown in FIG. 1, pivots toward and away from the printing bed 18, the press shown is manufactured by American Screen Printing Equipment Company of Chicago, Illinois, and is fully described in U.S. Pat. No. 3,955,501, patented May 11, 1976. The disclosure of that patent is incorporated herein in its entirety by this reference thereto.

The frame 12 of the feed and takeoff assembly 10 includes a pair of generally parallel side support members 20 and a pair of generally parallel end support members 21 joined to form a box-like structure, supported on one end by a vertical leg 19 and cantilevered to extend away from the printing bed 18 and the printing press 14 at the opposite end. As previously stated, this support frame is placed across the printing bed 18 and, for operation with press 14, is normally mounted across and under a vacuum-type printing bed, as will be described below. Within the side support members 20, and parallel thereto, are a pair of parallel tubular rails 22, extending the length of the support frame 12. These rails 22 are maintained in constant spaced relationship along the length of the frame 12. A feed and takeoff carriage 24, which will be described in detail below, is mounted on these rails for free movement therealong relative to the printing bed 18 and the printing press 14.

Carriage 24 includes an elongated feed gripper 26 mounted near the right-hand end thereof, as viewed in the drawings, and an elongated takeoff gripper 28 mounted near the opposite, or left-hand, end thereof. A pair of parallel spaced connecting rods 30 connect feed gripper 26 to takeoff gripper 28, as shown in FIG. 2. These connecting rods 30 are joined to one another by a transverse stabilizing member 70. The carriage 24 thus formed maintains the feed gripper 26 and takeoff gripper 28 in constantly spaced parallel relationship.

The feed gripper 26, in the preferred embodiment, includes a hollow elongated support bar 32 mounted transverse to the path of travel of the carriage 24, and having a plurality of ports (not shown) formed in it which are connected through suitable conduit to a vacuum source. The ports terminate in a series of suction cups 37, which project downwardly toward a first location 31 of stock to be transferred to the printing bed 18. This first location is shown in FIG. 1, as the surface of the right-hand outward extension of the feed and takeoff frame 12.

Figure 5:
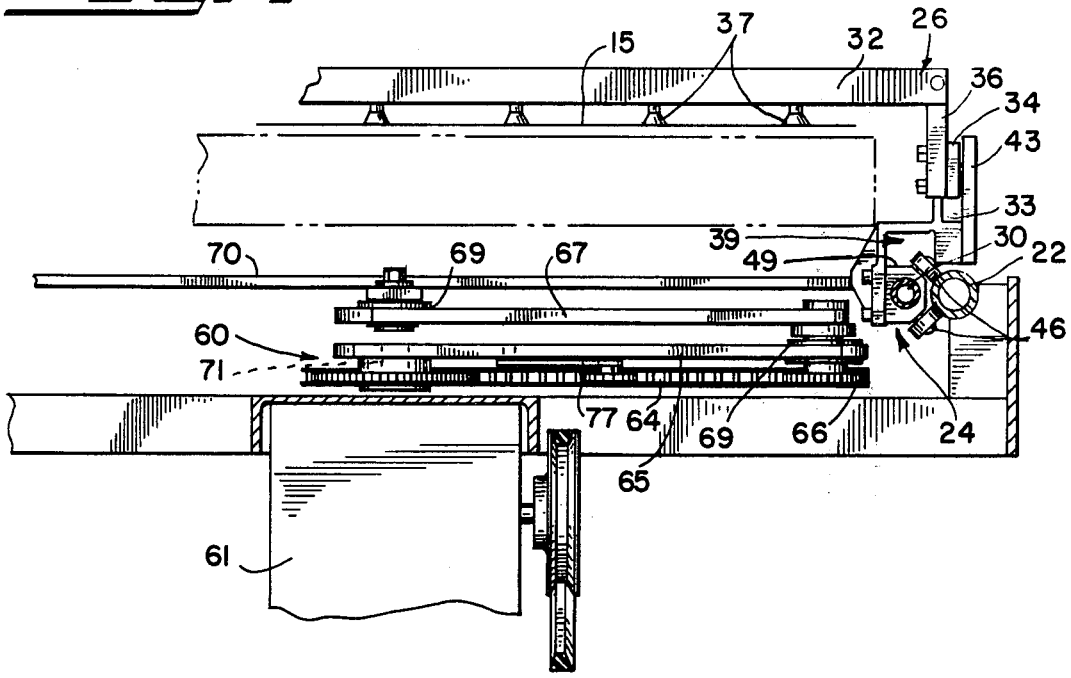
FIG. 5 is a transverse cross-sectional elevational veiw of the feed and takeoff apparatus of the present invention, showing the feed gripper member in the position of FIG. 4, and taken generally along line 5—5 of FIG. 2.

Feed gripper 26 is supported, at each end, by support post 36 fixedly attached to registration plates 34 (FIG. 5). Each registration plate 34 has a pair of spaced triangularshaped openings 35 formed in it which are mounted over a pair of spaced outwardly projection pins 45 (FIG. 3) formed on a mounting plate 38 which, in turn, forms the upper portion of a right-hand truck assembly 39. Truck assembly 39 also includes a main body 49 and a plurality of outwardly angled, low-friction rollers 46, which contact rails 22 and allow the entire carriage to move relative to the rails. A pair of horizontally disposed rollers 47 ride against opposite sides of a central stabilizing rail 44 to offset any lateral forces created by movement of the segmented driving crank 60 or the transfer carriage 24 (FIG. 2).

Figure 3:
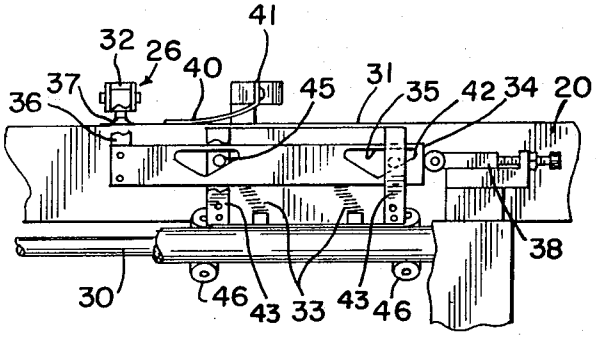
FIG. 3 is a front elevational, partially cutaway view of the feed and takeoff assembly of the present invention, showing, in particular, the detail at the opposite ends of the frame of the present invention with the transfer carriage in position for gripping stock to be printed and to deliver stock which has been printed.
Figure 3:
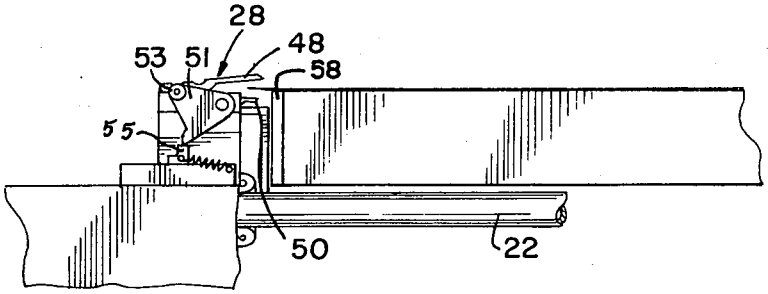

Each registration plate 34 is constantly urged upwardly against pins 45 by a pair of springs 33 of equivalent resilient means so that feed gripper 26 and its suction cups 37 are normally spaced above the surface of the feed and takeoff assembly 10, and above first position 31 in which the stock 15 is to be printed is maintained. A pair of outer cap bars 43 are positioned over the ends of pins 45 so that the registration plate 34 is retained between bars 43 and post 36, as shown in FIGS. 2 and 3. Registration plate 34 is shifted relative to camming pins 45 when it is moved into engagement with an adjustable stop 38 mounted at the end of rail 22. The surfaces of the triangular openings in the registration plate 34 are moved over the camming pins 45 to provide constant, repeated, similar movement of the elongated feed gripper 26 in both horizontal and vertical directions relative to the first or pickup position of the stock to be printed. In operation, when the end of registration plate 34 engages stop 38, the inclined cam following surface 42 of each opening 35 wil be moved downwardly vertically by the still forwardly moving cam pins 45. In other words, the feed gripper 26 will, as the truck assembly 39 reaches the end of the rail 22 adjacent first position 31, be moved vertically relative to the surface of the first position so that it comes into contact with the stock positioned thereon in an identical manner and in an identical registered position with each cycle of the feed and takeoff assembly. An elongated stock holddown apparatus 40 is mounted transversely across the first position 31 in which the stock to be printed is maintained, and has a plurality of spring fingers 41 pressing downwardly upon the top of the stock to be printed to maintain it in a desired position and location relative to the printing bed 18 (FIG. 2).

The takeoff gripper 28 is rigidly connected to the feed gripper 26 by the connecting rods 30 or similar means attached to their respective truck assemblies 39 which ride on rails 22 (FIG. 3). Takeoff gripper 28 is actuated at the same time as feed gripper 26 to remove a piece of stock which has been printed on printing bed 18 from the printing bed. Thus, takeoff gripper 28 opens and closes at the same time the feed gripper 26 is contacting and gripping by vacuum the piece of stock to be printed. Takeoff gripper 28 includes an upper jaw 48 and a lower jaw 50, which are movable in opposite directions on a common pivot rod 52 extending their length, and tranversely to their path of travel. Jaws 48 and 50 are separated by an internal arm 54 operated by an outer cam follower 51 which is tripped by a spring-returned dog 55 maintained in a fixed position on the frame 12 (FIG. 7). The takeoff gripper jaws 48 and 50, which are urged to a normally closed position by spring 56, operate in conjunction with a dropping edge 58 of printing bed 18 which, upon cam activation of the internal arm 54, is moved downwardly to reveal an outside edge of the stock which has been printed (FIGS. 3 and 4). This dropping edge 58 enables the entire surface of the stock to be supported and printed but also relieves the tendency of the stock to stick to the bed of the printing press after printing, and affords a significant gripping edge so that the takeoff gripping jaws will securely engage the stock after printing.

In an improved and preferred embodiment of the present invention, shown in FIGS. 10, 11 and 12, the takeoff gripper 100 includes a series of transversely-spaced upper jaws 98 and a plurality of smaller, transversely-spaced lower jaws 90, which are movable in opposite directions, the upper jaw being movable about the pivot 92 and the lower jaw being pivotal about the central axis of rod 94. Either jaw could be continuous rather than comprise discrete spaced units, as shown in FIG. 10. The lower jaw 90 is mounted on and pivots in conjunction with the rod 94. Jaw 90 is secured to rod 94 by means of a key 95, fitting into a cooperating keyway in both the rod 94 and the lower jaw 90. The rod 94 rests upon a base member 91, having a forward, vertically-extending flange which is discontinuous to accommodate lower jaws 90.

A bottom portion of the upper jaw 98 is clad with a metal or metal alloy plate 93, having a high lubricity coating thereon. For example, the plate 93 may comprise a steel or steel-bronze alloy, having a polytetrafluoroethylene coating. A rear portion 97 of the lower jaw 90 is in constant contact with this plate 93. Upon rotation of the rod 94 in a clockwise manner, this rear portion 97 of the lower jaw 90 acts as a camming surface to force the upper jaw 98 to move upwardly, concurrently with the downward movement of the forward portion 99 of the lower jaw 90. By reason of the high lubricity coating of the steel plate 93, little or no friction is generated, enabling a smooth movement of both lower and upper jaws with no seizing. In addition, a prolonged life of the two surfaces 93 and 97, which are in constant rubbing contact with each other, becomes possible.

The takeoff gripper jaws 90 and 98 are urged to the normally closed position, shown in FIG. 11, by a spring 96 disposed around the lower portion of bolt 101, which is inserted through and connects the upper jaw 98 to base 91. Spring 96 is compressed between base 91 and nut 102 so that upper jaw 98 is constantly biased toward base 91 and against lower jaw 90. A radiused pivot 104 seats bolt 101 against upper jaw 98 to facilitate movement of jaw 98. As the jaw 98 moves to the open and closed positions, the radiused pivot changes its position relative to the upper jaw seat 105, while maintaining the same position relative to the bolt 101. Thus, the jaws may freely pivot, with little or no wear from the bolt 101, and yet maintain the proper biasing force to normally urge the jaws to a closed position. These gripper jaws can operate in conjunction with a dropping edge 58 of a printing bed 18 which, upon cam activation of the internal arm 94, is also moved, downwardly, to reveal an outside edge of the stock which has been printed.

In operation, then, the takeoff gripper assembly 100 is normally maintained in close proximity to the sheet stock 102 during the printing cycle. In fact, because of its low profile, it may be located under the printing head during printing and may or may not actually grip the stock. This delivery gripper is activated in the same manner as that described above. That is, a cam follower, such as 51, is mounted on one end of rod 94 and operated as described above to open the normally closed gripper jaws to grip the stock. The jaws are opened by the rotation of rod 94, which moves the camming surface 97 of lower jaw 90 against plate 93 of upper jaw 98 to move the forward portion of each jaw away from one another to the position shown in FIG. 12. After the jaws have been opened, spring 96, which constantly urges the jaws toward one another through bolt 101, causes rod 94 to be oppositely rotated so that the series of gripper jaws mounted on rod 94 are simultaneously closed on a leading edge of the stock 102, as shown in FIG. 10. The takeoff gripper assembly 100 then transfers the sheet stock 102 to a delivery position in a manner to be described, after which the takeoff gripper assembly 100 returns to the initial rest position.

By the use of the above-described embodiment of the takeoff gripper assembly 100, the takeoff gripper jaws 98 and 90 can provide a larger open position of the forward portions of the jaws by which an edge of the printed stock may be engaged. As is well known, a printed stock may present a curled edge to the takeoff gripper, which may be either in an upward direction or in a downward direction. By the use of the takeoff gripper jaws 100, either of these curled directions can be engaged easily and securely. Further, stock which presents a large amount of curl in either direction is also easily engaged. Thus, the problems encountered in the prior art whereby the automatic takeoff grippers required substantially flat stock in order to work efficiently are hereby obviated by the use of the present invention.

While disclosed as a cooperating element of the inventive feed and takeoff assembly herein, the takeoff gripper 100 can also be used alone in an automatic or semi-automatic takeoff apparatus in conjunction with presently-existing printing presses, such as that shown in U.S. Pat. No. 3,859,917.

The takeoff gripper of the subject invention has a low profile when in the closed position. Thus, the gripper may be positioned immediately adjacent the printing bed during the printing cycle without contacting the printing head. This location allows an almost immediate gripping of the stock after printing and a quick subsequent removal, since there is practically no travel time necessary to position the gripper for securing the printed stock, as is necessary with the grippers of the prior art.

As can be appreciated from the above description, a significant feature of this invention is that only two grippers are used to feed, register and remove stock relative to a printing press. These two grippers extend transversely to their path of travel and are integrally or rigidly connected to each other so that they move simultaneously and in constant spaced relationship with one another. Thus, there is never any need to register or adjust one gripper with respect to the other, or to register the feed gripper with respect to the edge of the printing bed.

The invention also involves a unique apparatus for regulating the speed at which the transfer carriage 24 and the feed and takeoff grippers mounted thereon move. Transfer carriage 24 is moved by a feed and takeoff drive motor 61, which is completely independent of any motor associated with the press, but is in electrical communication therewith so that the operation of the printing head of the press and the infeed and takeoff assembly may be synchronized. This motor is directly connected by a drive belt 59, shown in FIG. 8, to a reduction assembly 62, having an output shaft 71, which in turn drives a segmented drive crank 60, as will be explained below.

The drive crank 60 includes a rotating main drive gear or sprocket 63 mounted on shaft 71 (FIG. 2). Shaft 71 also has fixedly mounted, on its upper end, one end of an elongated first drive arm 65, which moves angularly with the main drive gear 63. At the opposite, outer end of first drive arm 65 is mounted a second perpendicular shaft 68, which extends therethrough. At the bottom end of shaft 68 is fixedly mounted a second driven gear or sprocket 66. This second driven gear 66 is connected to the main drive gear 63 by a link chain 64 so that movement of main drive gear 63 will produce corresponding movement of driven gear 66 to rotate shaft 68 freely within a bushing 79 through drive arm 65. At the opposite end of second shaft 68 is mounted a second arm 67, which rotates with shaft 68 and second driven gear 66. Thus, as the main drive gear rotates in a clockwise direction, and along with it the first drive arm 65, the second driven gear 66 and second drive arm 67 are rotated in a counterclockwise direction so that shaft 68 is moved toward shaft 71. At the opposite or outer end of second arm 67, a hitch arm 69 is mounted on a third shaft or pin 74, which is free to move within a bushing 75 mounted in second arm 67. Hitch arm 69 is attached to its opposite end in a fixed manner to a transverse stabilizer member 70, which forms part of the transfer carriage.

The action of the driving crank assembly 60 is shown in the solid and hidden lines in FIG. 2. It is seen that the arms of this crank assembly 60 fold up on one another as it moves from right to left to permit the transfer carriage on which the feed gripper and takeoff gripper are mounted to be moved a significant distance relative to the frame to feed stock without the use of a correspondingly long drive arm and an unmanageably wide frame 12. It can be readily seen that by extending the segmented crank assembly 60, or adding arms as desired, the length of travel of the transfer carriage can be easily increased to accommodate various size printing operations. A positionable tension lever member and gear 77 is mounted on first drive arm 65 to maintain tension in the chain 64.

The segmented construction of the drive crank assembly 60 also provides for a slight or reduced linear movement of the transfer carriage 24 at the positions and times where the feed gripper and takeoff gripper are in the act of gripping and releasing stock to assure proper gripping at these points. The unique construction of the crank assembly produces a harmonious motion in the carriage 24, despite the constant angular speed of the shaft 71 through this time period because when the first arm 65 and second arm 67 are in a straight line extended relationship, as shown in FIG. 2, or in a collapsed relationship in a position parallel to rails 22, movement of the main drive gear through a certain particular arc will only produce a slight linear movement of the arms and carriage assembly. As the first and second arms reach a position perpendicular to rails 22, however, as shown in hidden lines in FIG. 2, a slight angular movement of the main drive gear will produce a corresponding linear movement of the carriage.

When the crank assembly reaches a left-hand extended position, as shown in the dotted lines in FIG. 2, the carriage assembly 24 is in the second or print position where the sheet of stock 15 is positioned over the printing bed 18 and under the printing head 16 of the printing press for printing. Feed gripper 26 will be moved adjacent the printing bed 18 as registration plate 34 engages stop 38', as shown in FIG. 6, to move feed gripper bar 32 in a similar manner to that described above, over camming surface 42' (FIG. 6). At the same time, a roller 53 on gripper cam follower 51 engages a cam ramp 57 mounted on support member 20 at the third or delivery position to rotate internal cam rod 54

(FIG. 7), in the same manner as previously described, to force open jaws 48 and 50 and release the printed stock for drying.

Movement of the transfer carriage is also controlled by a series of stacked control cams 72, which are formed to activate control switches 73 which are adjacent thereto (FIG. 8). These cams, which are mounted on shaft 71 to rotate with main driven gear 63, will, as they rotate, engage various switches 73 at selected times to thereby activate different operations of the takeoff and also the printing press. For example, the operation of a single illustrative control cam 75 and the circuit controlling the speed of the DC motor 61 driving the carriage assembly 24 is shown in FIG. 9. During the feed portion of the movement of the transfer carriage 24, that is, movement between the right-hand end and the printing bed with a sheet of stock to be printed, and corresponding delivery of a just-printed sheet of stock, cam 75 closes switch 76 to complete circuit 78', having a variable resistance, through motor 61. This will directly control the motor speed, and thereby the speed of the carriage assembly. When the carriage assembly 24 reaches the delivery position for both the delivery and feed grippers, however, a second cam, such as 80, engages a switch 81 to stop the vaccum to the suction cups and provide positive blowback along with a vacuum holddown on the printing press to positively release the stock 15 (FIG. 5). The cam 75 then acts to allow switch 76 to close on circuit 78 through DC motor 61, which circuit contains a decreased amount of resistance. This decreased resistance 82 will increase the speed of the motor and, therefore, the rate of return of the transfer carriage 24 from left to right to its original starting position, shown in FIG. 1.

Third and/or fourth cams may be employed, as shown in FIG. 8, so that camming surfaces thereon engage switches as the transfer carriage is returning to its first position, to lower the printing head 16 and activate the printing cycle. By such controls, the transfer of stock from the first or ready position to a second or print position and simultaneous delivery of printed stock to a third or delivery position can be accomplished in synchronization with printing of stock on a printing bed.

In an alternative form or mode, the feed gripper 26 can deliver the stock to the printing bed 18 and, by action of similar camming controls, disengage from movement by the drive motor 61 for a sufficient period to allow the printing head 16 of the printing press to descend over the stock maintained in position by the feed bar 32 to print the same. Use of the feed bar 32 to hold the stock down will prevent any movement of the stock and insure exact registration despite repeated printing on the same sheet of stock in multiple colors. The variation in the timing above suggested can, of course, be accomplished by substitution of various shaped cams and a movement of the cams on the shaft 71, on which they are mounted, relative to the switches 73.

While the above invention has been described in relation to a preferred embodiment thereof, it will be apparent to those skilled in the art that this structure is capable of wide variation without departing from the principles of the invention.

I claim:

1. In a gripper assembly particularly adapted for use with a printing press having a printing head for the controlled transfer of sheet stock, the improvement comprising gripper jaw means having at least one upper jaw and at least one lower jaw, each of said upper jaw and said lower jaw having a forward portion, each of said forward portions being movable away from the other to an open position and movable toward the other to a closed position, a camming means integral with said lower jaw for pivotal movement about an axis generally parallel to a leading edge of said sheet stock, said upper jaw being biased against said camming means by resilient means to assure responsive contact between said camming means and said upper jaw, said camming means pivotable about said axis to displace said forward portions of said upper jaw and said lower jaw into said open position for accepting sheet stock, said camming means being thereafter movable about said axis to return said upper jaw and said lower jaw to a closed position for gripping said sheet stock for subsequent transfer by the movement of said gripper assembly.

2. The improvement of claim 1 wherein said lower jaw includes a forward portion and a rear portion, said rear portion having an upper, arcuate camming surface in constant contact with said upper jaw, said lower jaw being mounted on an elongated rod and angularly movable therewith about a central axis thereof such that said upper jaw and said lower jaw may be successively displaced to said open position and to said closed position when said rod is moved.

3. The improvement of claim 1 wherein said gripper jaw means is mounted at a low elevation when in said closed position to present a low profile relative to said printing head when in a printing position, allowing said gripping position to be maintained during the printing cycle and vertically spaced at all times from the printing head.

4. A feed and takeoff assembly particularly adapted for automatically transferring generally flat stock, such as that used in printing, from a first position, where said stock may be registered, through a second position, where said stock may be printed, and to a third position, including a frame, a first gripper means for selecting and feeding a single sheet of stock from said first position to said second position while maintaining registration of said sheet of stock, second gripper means for removing and delivering said single sheet of stock from said second position to said third position, said second gripper means including upper jaws and lower jaws, each of said upper jaws being pivotal about the rear portion thereof and biased for sliding contact against a rear, arcuate portion of each of said lower jaws, each of said lower jaws being mounted on a camming rod and pivotal therewith about a central axis of said rod such that angular movement of said rod causes an upward movement of said rear portion of each of said lower jaws and a corresponding upward movement of a forward portion of each of said upper jaws toward an open position of said second gripper means, said first gripper means and said second gripper means being mounted on said frame and interconnected for joint movement relative to said frame, said first gripper means and said second gripper means being maintained in a predetermined spaced relationship relative to one another to provide a single, reliable, unitarily movable unit for feeding and delivering stock during a printing operation.

* * * * *